US010353341B2

(12) United States Patent
Choi et al.

(10) Patent No.: US 10,353,341 B2
(45) **Date of Patent: *Jul. 16, 2019**

(54) IMAGE FORMING APPARATUS AND METHOD OF CONTROLLING FUSER

(71) Applicant: HP PRINTING KOREA CO., LTD., Suwon-si, Gyeonggi-Do (KR)

(72) Inventors: Hwa-chul Choi, Suwon (KR); Yun-su Kim, Suwon (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/918,533

(22) Filed: Mar. 12, 2018

(65) Prior Publication Data

US 2018/0203409 A1 Jul. 19, 2018

Related U.S. Application Data

(63) Continuation of application No. 15/595,159, filed on May 15, 2017, now Pat. No. 9,958,827.

(30) Foreign Application Priority Data

May 27, 2016 (KR) ..... 10-2016-0065323

(51) Int. Cl.

| | |
|---|---|
| ***G03G 15/20*** | (2006.01) |
| ***G03G 21/20*** | (2006.01) |
| ***G03G 15/01*** | (2006.01) |

(52) U.S. Cl.

CPC ..... *G03G 21/20* (2013.01); *G03G 15/011* (2013.01); *G03G 15/2039* (2013.01)

(58) Field of Classification Search

CPC ..... G03G 21/20; G03G 15/0111; G03G 15/2039

USPC ..... 399/69

See application file for complete search history.

(56) References Cited

U.S. PATENT DOCUMENTS

| | | | |
|---|---|---|---|
| 7,015,431 | B2 | 3/2006 | Yoshimura et al. |
| 7,310,486 | B2 | 12/2007 | Kawazu et al. |
| 8,618,449 | B2 | 12/2013 | Kim |
| 2006/0291883 | A1 | 12/2006 | Chae et al. |
| 2007/0193998 | A1 | 8/2007 | Ichino et al. |
| 2013/0266334 | A1 | 10/2013 | Shimura et al. |

FOREIGN PATENT DOCUMENTS

| | | | |
|---|---|---|---|
| JP | 08-87199 | A | 4/1996 |
| JP | 2005-24779 | A | 1/2005 |
| JP | 2006-184418 | A | 7/2006 |
| JP | 5523190 | B2 | 6/2014 |
| KR | 10-0699475 | | 3/2007 |

OTHER PUBLICATIONS

Rawlins, Basic AC Circuits, 2000, Butterworth-Heinemann, 2nd Edition, pp. 31-32.*

* cited by examiner

*Primary Examiner* — Susan S Lee

(74) *Attorney, Agent, or Firm* — Staas & Halsey LLP

(57) ABSTRACT

An image forming apparatus comprises a fuser to fuse a print sheet having a surface on which toner is developed, the fuser including a heating element, and a controller to control a number of waveforms of an alternating current (AC) power to be supplied to the heating element, within a control cycle to control the fuser to fuse the print sheet at a target temperature and to vary the control cycle, according to a temperature of the fuser.

20 Claims, 12 Drawing Sheets

IMAGE FORMING APPARATUS AND METHOD OF CONTROLLING FUSER

CROSS-REFERENCE TO RELATED APPLICATIONS

This application is a continuation application of U.S. patent application Ser. No. 15/595,159, filed on May 15, 2017, which claims priority from Korean Patent Application No. 10-2016-0065323, filed on May 27, 2016, in the Korean Intellectual Property Office, the disclosure of which is incorporated herein by reference in its entirety.

BACKGROUND

An image forming apparatus refers to an apparatus that prints print data, which is generated from a print control terminal apparatus such as a computer, on a print sheet. Examples of the image forming apparatus may include a copier, a printer, a fax machine, a Multi-Function Peripheral (MFP) that complexly realizes their functions through one apparatus, and the like.

An image forming apparatus may form images by using various methods. An electrophotographic method is used as one of the above-mentioned methods. The electrophotographic method refers to a method of forming an image through a process of charging a surface of a photoconductor, forming a latent image through an exposure, performing a development job of coating the latent image with toner, and transferring and fusing the developed toner onto a printer sheet.

As described above, an image forming apparatus may use an element that finally fuses an image on a print sheet. This element is referred to as a fuser.

BRIEF DESCRIPTION OF THE DRAWING FIGURES

Certain examples of the present invention with reference to the accompanying drawings are described, in which.

DETAILED DESCRIPTION

Figure 1:
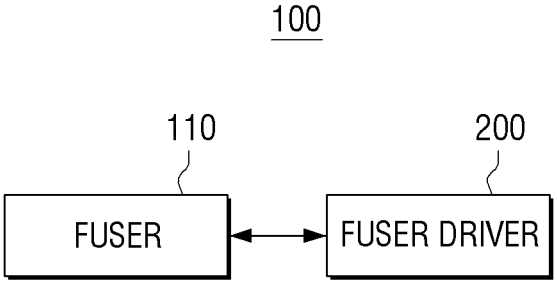
FIG. 1 is a block diagram of a simple structure of an image forming apparatus according to an example.

According to existing technology, a temperature of a fuser is controlled by varying merely charge duty of the fuser on a fixed control cycle. However, it may be impossible to perform a precise temperature control close to a target temperature on a fixed control cycle in a fuser having fast heating and cooling rates. Therefore, overshooting and undershooting of a fusing temperature occur, thereby causing a problem of fusing an image.

To solve such problem, examples will now be described in greater detail with reference to the accompanying drawings.

In the following description, same drawing reference numerals are used for the same elements even in different drawings. The matters defined in the description, such as detailed construction and elements, are provided to assist in a comprehensive understanding of the disclosure. Thus, examples can be carried out without those specifically defined matters.

As used herein, when an element is connected to another element, this includes a "direct connection" and "an indirect connection through another medium". Unless otherwise defined, when an element "includes" another element, it may mean that the element further include other elements without excluding other elements.

An "image forming job" used herein may refer to various types of jobs (e.g., printing, scanning, faxing, and the like) associated with an image, like forming of an image, generating, storing, or transmitting of an image file, and the like. A "job" may refer to an image forming job or may refer to a meaning including all of a series of processes necessary for performing the image forming job.

Also, an "image forming apparatus" refers to an apparatus that prints print data, which is generated from a terminal apparatus such as a computer, on a recording sheet. Examples of the image forming apparatus may include a copier, a printer, a fax machine, a multi-function peripheral (MFP) that complexly realizes their functions through one apparatus, and the like. The image forming apparatus may refer to all types of apparatuses capable of performing image forming jobs, like a printer, a scanner, a fax machine, an MFP, a display apparatus, or the like.

In addition, a "hard copy" may refer to an operation of outputting an image to a print medium, such as paper or the like, and a "soft copy" may refer to an operation of outputting an image to a display apparatus such as a TV, a monitor, or the like.

"Contents" may refer to all types of data that are targets of image forming jobs such as images, document files, and the like.

"Print data" may refer to data that is converted into a printable format in a printer. If a printer supports direct printing, a file may be print data.

Also, a "user" may refer to a person who performs a manipulation associated with an image forming job by using an image forming apparatus or a device connected to the image forming apparatus by wire or wireless. A "manager" refers to a person who has a right to access all functions of the image forming apparatus and a system. The "manager" and the "user" may be the same person.

FIG. 1 is a block diagram of a simple structure of an image forming apparatus 100 according to an example.

Referring to FIG. 1, the image forming apparatus 100 according to an example includes a fuser 110 and a fuser driver 200.

The fuser 110 fuses a print sheet on which toner is developed. In detail, the fuser 110 fuses charge toner on the print sheet onto the print sheet by applying heat and pressure to the print sheet. The fuser 110 may include a heating roller and a pressurizing roller.

The heating roller is heated to a preset temperature to apply heat to the print sheet so as to easily fuse the charge toner on the print sheet. The heating roller may include a heating element (e.g. a heater lamp) for heating the heating roller to a preset temperature. Herein, one heating element or a plurality of heating elements may be included. The heating element may be heated by a power source supplied from the fuser driver 200 that will be described later For fast heating, the heating roller may also include a fusing member that includes a cylindrical belt and a heating element that is installed in the corresponding cylindrical belt.

The pressurizing roller is a roller that provides the print sheet with high pressure to easily fuse the charge toner on the print sheet and is pressure-welded to the heating roller to form a nip.

The fuser driver 200 may be realized as a combination of a processor, an application-specification integrated circuit (ASIC), a central processing unit (CPU), and a switch that selectively supplies an external AC to the heating element and may control a power source supplied to the heating element so as to enable the heating roller to have a preset temperature status depending on an operation status of the image forming apparatus 100. For example, if the operation status of the image forming apparatus 100 is a printing status, the fuser driver 200 may control the power source supplied to the heating element so as to enable the heating roller to have a preset target temperature necessary for fusing. Also, for fast printing, even if the operation status of the image forming apparatus 100 is a standby status or a preparatory status, the fuser driver 200 may control the power source supplied to the heating element so as to enable the heating roller to have a temperature lower than a temperature necessary for fusing.

In addition, the fuser driver 200 may control the power source supplied to the heating element by varying a control cycle of the fuser 110 according to a temperature of the fuser 110. In detail, if the operation status of the image forming apparatus 100 is an initial on-status (or the preparatory status), the fuser driver 200 may control an AC power source supplied to the heating element by using a first control cycle set by default and control an AC power source to the heating element by using a second control cycle shorter than the first control cycle within a second temperature range that becomes higher than a first temperature range due to a rise in a temperature of the fuser 110.

Here, the fuser driver 200 may calculate conduction duty according a sensed temperature within each control cycle, determine a cycle to which the calculated conduction duty is to be applied, calculate the number of waveforms hours of an AC power source that is to be applied to the fuser 110 according to the determined conduction duty and the calculated cycle, and control the AC power source based on the calculated the number of waveforms hours. The controlling of the number of waveforms hours is a control method of supplying an AC power to the heating element by wave numbers.

Also, if the operation status of the image forming apparatus 100 changes from the printing status into the standby status, the fuser driver 200 may control the number of waveforms hours of the AC power source by gradually lengthening a control cycle in an opposite order to the above-described order.

As described above, a control cycle is changed in phases according to a temperature range of a fuser but may be varied in inverse proportion to a sensed temperature.

The fuser driver 200 has been described above as performing merely controlling of the number of waveforms hours. However, the above-described method of varying the control cycle may be provided for a method of controlling a power source supplied to a heating element in a phase control method.

As described above, the image forming apparatus 100 according to an example performs a temperature control on a shorter control cycle as a temperature of a fuser is close to a target temperature and thus may perform a more precise temperature control. If a precise control is not needed, the image forming apparatus 100 re-performs the temperature control on a long control cycle and thus may reduce resources necessary for the temperature control performed in the image forming apparatus 100.

Merely simple elements constituting an image forming apparatus have been illustrated and described above, but various types of elements may be additionally included. Hereinafter, this will be described with reference to FIG. 2.

Figure 2:
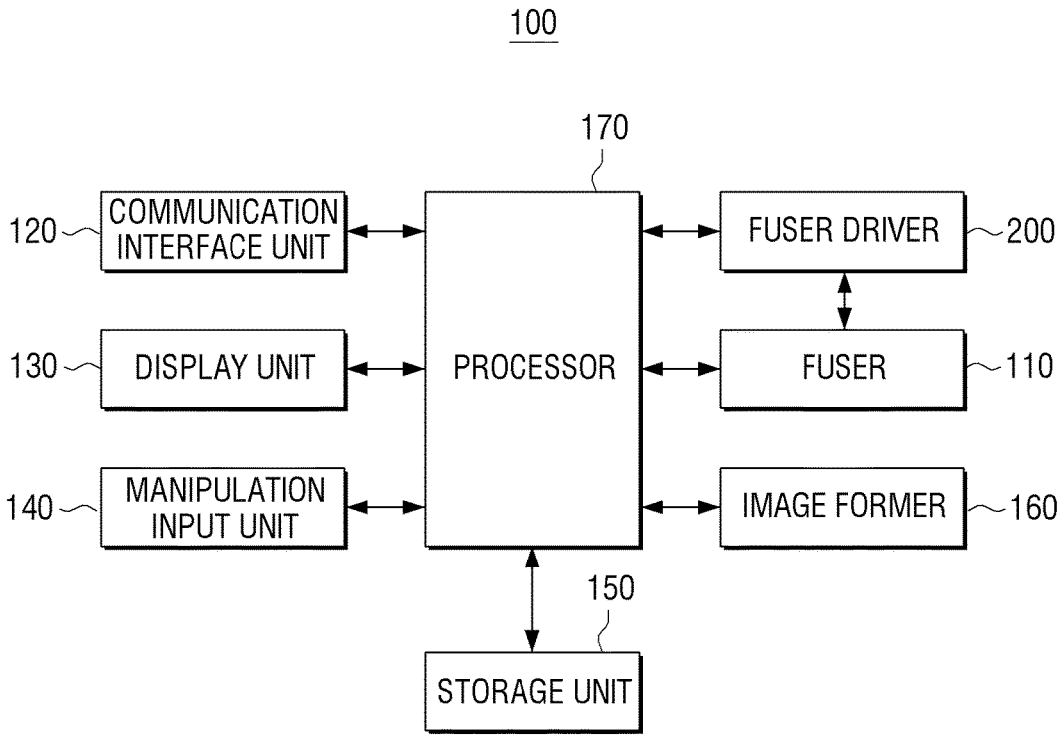
FIG. 2 is a block diagram of a detailed structure of an image forming apparatus according to an example.

FIG. 2 is a block diagram of a detailed structure of the image forming apparatus 100, according to an example.

Referring to FIG. 2, the image forming apparatus 100 includes the fuser 110, a communication interface unit 120, a display unit 130, a manipulation input unit 140, a storage unit 150, an image former 160, a processor 170, and the fuser driver 200.

The fuser 110 and the fuser driver 200 perform fusing functions. Merely the fuser 110 and the fuser driver 200 may be referred to as a fusing apparatus in the image forming apparatus 100, and detailed structure and operation of the fusing apparatus will be described later with reference to FIG. 4.

The communication interface unit 120 may be connected to a terminal apparatus (not shown) such as a mobile device (e.g., a smartphone, a tablet personal computer (PC), or the like), a PC, a notebook PC, a personal digital assistant (PDA), a digital camera, or the like and may receive a file and print data from the terminal apparatus. In detail, the communication interface unit 120 may be formed to connect the image forming apparatus 100 to an external apparatus and may be connected to the terminal apparatus through a Local Area Network (LAN) and an Internet network or through a Universal Serial Bus (USB) port or a wireless communication (e.g., wireless fidelity (WiFi) 802.11a/b/g/n, Near Field Communication (NFC), Bluetooth) port.

The display unit 130 displays various types of information provided in the image forming apparatus 100. In detail, the display unit 130 may display a user interface window for selecting various types of functions provided by the image forming apparatus 100. The display unit 130 may be a monitor such as a Liquid Crystal Display (LCD), a Cathode-Ray Tube (CRT), an Organic Light Emitting Diode (OLED), or the like or may be realized as a touch screen capable of simultaneously performing a function of the manipulation input unit 140 that will be described later.

Also, the display unit 130 may display a control menu for performing a function of the image forming apparatus 100.

The manipulation input unit 140 may receive a function selection and control command of the corresponding function from a user. Here, the function may include a printing function, a copying function, a scanning function, a fax transmitting function, or the like. The manipulation input unit 140 may receive the function selection and the control command through a control menu displayed on the display unit 130.

The manipulation input unit 140 may be realized as a plurality of buttons, a keyboard, a mouse, or the like or as a touch screen capable of simultaneously performing the above-described function of the display unit 130.

The storage unit 150 may store print data received through the communication interface unit 120. The storage unit 150 may also store various types of fusing conditions (e.g., a temperature condition depending on an operation status of the image forming apparatus 100 and the like). The storage unit 150 may be realized as a storage medium of the image forming apparatus 100 or an external storage medium, for example, as a removable disk including a USB memory, a storage medium connected to a host, a web server through a network or the like.

The image former 160 may print data. The image former 160 may form an image on a recording medium according to various types of printing methods such as an electrophotography method, an ink-jet method, a thermal transferring method, a cooling method, and the like. For example, the image former 160 may print the image on the recording medium by a series of processes including exposing, developing, transferring, and fusing processes. A detailed structure of the image former 160 will be described later with reference to FIG. 3.

The processor 170 respectively controls elements of the image forming apparatus 100. In detail, the processor 170 may be realized as a CPU, an ASIC, or the like and may determine an operation status of the image forming apparatus 100. For example, if it is determined that the image forming apparatus 100 is initially turned on or a printing job is in an instantly starting status (e.g., if a user controls a manipulation input unit or receives print data), the processor 170 may determine the operation status of the image forming apparatus 100 as a preparatory status (or ready status). Here, the processor 170 may control the fuser driver 200 so as to enable the fuser driver 200 to have a fusing temperature depending on an initial status.

If an operation, such as parsing or the like, is completed, and thus a printing job is to start by receiving print data from an external source, the processor 170 may determine the operation status of the image forming apparatus 100 as a printing status. Here, the processor 170 may control the image former 160 to perform a series of processes so as to enable charge toner to be developed on a print sheet and may control the fuser driver 200 so as to enable the fuser 110 to have a target temperature necessary for fusing. Also, if the charge toner is developed on the print sheet, the processor 170 may control the fuser 110 so as to enable the charge toner to be fused on the print sheet.

In addition, if a preset time elapses after the printing job is completed, the processor 170 may determine the operation status of the image forming apparatus 100 as the standby mode. Here, the processor 170 may control the fuser driver 200 so as to enable the fuser 100 to maintain a lower temperature than a temperature necessary for fusing.

As described above with reference to FIGS. 1 and 2, the fuser driver 200 performs a fusing function under control of the processor 170. However, the fuser driver 200 may perform the fusing function under control of the image former 160. Also, the fuser driver 200 and the fuser 110 may be realized as elements of the image former 160.

Also, as described above with reference to FIGS. 1 and 2, the fuser driver 200 directly controls the number of waveforms hours. However, the processor 170 may generate a driving signal according to the control of the number of waveforms hours depending on a fuser temperature, and the fuser driver 200 may perform merely an operation of selectively supplying an external AC power source to the heating element of the fuser 110 according to the driving signal provided from the processor 170. In other words, the processor 170 may perform the above-described operation of the fuser driver 200 that generates the driving signal.

A function of the image forming apparatus 100 has been illustrated and described with reference to FIGS. 1 and 2. However, the image forming apparatus 100 may further include a scanner that performs a scanning function, a fax transceiver that performs a fax transceiving function, and the like according to functions supported by the image forming apparatus 100.

Figure 3:
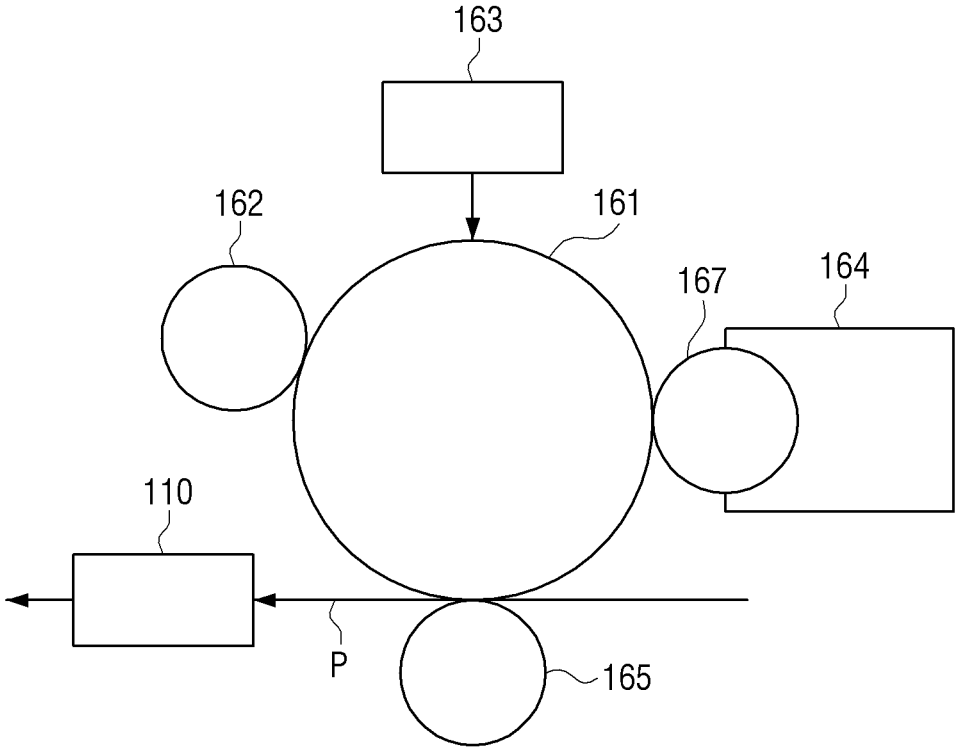
FIG. 3 illustrates a configuration of an image former of FIG. 2, according to an example.

FIG. 3 illustrates a structure of the image former 160 of FIG. 2, according to an example.

Referring to FIG. 3, the image forming 160 may include a photoconductor 161, a charger 162, an exposure unit 163, a developing unit 164, a transfer unit 165, and the fuser 110.

The image former 160 may further include a feeding means (not shown) that feeds recording media P. An electrostatic latent image is formed on the photoconductor 161. The photoconductor 161 may be referred to as a photoconductive drum, a photoconductive belt, or the like according to a shape thereof.

The charger 162 charges a surface of the photoconductor 161 with uniform electric potential. The charger 162 may be realized as a corona charger, a charge roller, a charge brush, or the like.

The exposure unit 163 forms an electrostatic latent image on the surface of the photoconductor 161 by changing a surface potential of the photoconductor 161 according to image information that is to be printed. For example, the exposure unit 163 may form the electrostatic latent image by irradiating modulated light according to the image information that is to be printed. The exposure unit 163 having the above-described type may be referred to as an optical scanner or the like, and an LED may be used as a light source.

The developing unit 164 houses a developer therein and develops the electrostatic latent image as a visible image by supplying the developer to the electrostatic latent image. The developing unit 164 may include a developing roller 167 that supplies the developer to the electrostatic latent image. For example, the developer may be supplied from the developing roller 167 to the electrostatic latent image formed on the photoconductor 161 by developing electric field formed between the developing roller 167 and the photoconductor 161.

The visible image formed on the photoconductor 161 is transferred onto the recording medium P by the transfer unit 165 or an intermediate transfer belt (not shown). The transfer unit 165 may transfer the visible image onto the recording medium P according to an electrostatic transfer method. The visible image adheres onto the recording medium P by an electrostatic attraction.

The fuser 110 fuses the visible image onto the recording medium P by applying heat and/or pressure to the visible image formed on the recording medium P. A printing job is completed through a series of processes described above.

The aforementioned developer is used whenever an image forming job is performed, and thus is exhausted after being used for a preset time or more. In this case, a unit (e.g., the developing unit 164 described above) that houses the developer may be newly replaced. Parts or elements that are replaceable in a process of using an image forming apparatus as described above are referred to as consumable units or replaceable units. Also, a memory (or a CRUM chip) may be adhered to such a consumable unit to appropriately manage the corresponding consumable unit.

Figure 4:
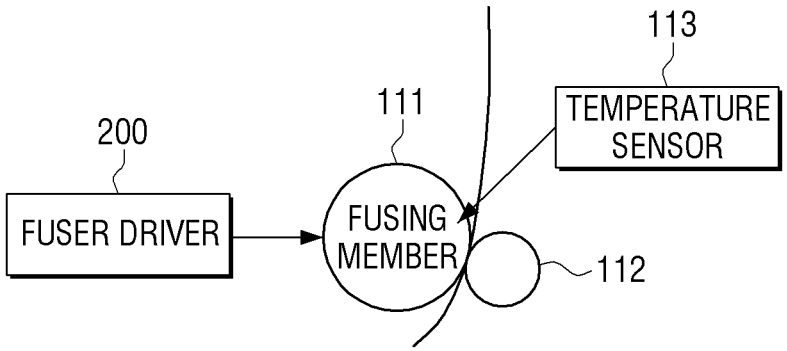
FIG. 4 is a block diagram of a detailed structure of a fusing apparatus according to an example.

FIG. 4 is a block diagram of a detailed structure of a fusing apparatus according to an example.

Referring to FIG. 4, the fusing apparatus may include the fuser 110 and the fuser driver 200.

The fuser 110 fuses a print sheet on which toner is developed. In detail, the fuser 110 may include a fusing member 111, a pressurizing member 112, and a temperature sensor 113.

The fusing member 111 is heated to a preset temperature and thus applies heat to a print sheet so as to enable charge toner on the print sheet to be easily fused. The fusing member 111 may be realized as a heating roller including a heater lamp or as a cylindrical belt.

If the fusing member 111 is realized as the cylindrical belt, the fusing member 111 may include a heating element that heats the fusing member 1111. Here, one heating element or a plurality of heating elements may be included. The heating element may be heated by a power source supplied from the fuser driver 200 that will be described later and may heat the fusing member 111 with contactless radiant heat.

The pressurizing member 112 may be a roller that provides a print sheet with high pressure so as to enable charge toner on the print sheet to be easily fused and may be pressure-welded to the fusing member 111 to form a nip.

The temperature sensor 113 senses a temperature of the fusing member 111. In detail, the temperature sensor 113 may sense the temperature of the fusing member 111 and provide the fuser driver 200 or the processor 170 with a sensing value corresponding to the sensed temperature. Here, the temperature sensor 113 may provide the fuser driver 200 or the processor 170 with a difference between a pre-stored target temperature value and the sensed sensing value.

Here, a case where the temperature sensor 113 provides the fuser driver 200 with the sensing value corresponds to a case where the fuser driver 200 performs a control of the number of waveforms hours of an AC power source. Also, a case where the temperature sensor 113 provides the processor 170 with the sensing value corresponds to a case where the processor 170 performs a control of the number of waveforms hours of the AC power source, and the fuser driver 200 performs merely a switching operation according to a driving signal generated by the processor 170. Hereinafter, for easy description, the fuser driver 200 will be described as performing a control of the number of waveforms hours of an AC power source.

The fuser driver 200 receives temperature information from the temperature sensor 113. Here, the fuser driver 200 may receive a difference value between a target temperature value and a sensed temperature value. In this case, the fuser driver 200 may calculate a duty value and a cycle, to which the duty value is to be applied, based on received information. The fuser driver 200 may receive merely a currently sensed temperature value from the temperature sensor 113, calculate a pre-stored target value and a sensed temperature value, and calculate a duty value and a cycle (duty) by using the calculation result.

Also, the fuser driver 200 may control a power source supplied to the heating element by varying a control cycle of the fuser 110 according to a temperature of the fuser 110. In detail, if an operation status of the image forming apparatus 100 is an initial on status (or a preparatory status), the fuser driver 200 may generate a driving signal for controlling an AC power source supplied to the heating element by using a first control cycle set by default and may generate a driving signal for controlling an AC power source supplied to the heating element by using a second control cycle shorter than the first control cycle within a second temperature range that becomes higher than a first temperature range due a rise in the temperature of the fuser 100.

Here, within each control cycle, the fuser driver 200 may calculate conduction duty according to a sensed temperature, determine a cycle to which the calculated conduction duty is to be applied, calculate a waveform time of an AC power source that is to be supplied to the fuser 110 according to the determined conduction duty and the calculated cycle, and control the AC power source based on the calculate waveform time. The control of the number of waveforms hours is a control method of supplying the AC power to the heating element by wave numbers.

Also, after performing the control of the number of waveforms hours according to conduction duty calculated for the determined cycle, the fuser driver 200 may vary a control cycle if the control cycle is to be changed and may perform the number of waveforms hours by determining conduction duty that is to be applied within the varied control cycle and a cycle to which the calculated conduction duty is to be applied. The change of the control cycle may be performed by multiples of a currently set control cycle.

The fuser drive 200 may also include a control integrated circuit (IC) and a switch. Here, the control IC may generate a driving signal by performing a calculation and a control of the number of waveforms hours as described above by using an operation apparatus such as a CPU, an ASIC or the like. Also, the switch may include a triac switch, a relay switch, or the like and selectively supply an external AC to the heating element according to the driving signal. Also, the control IC may include a plurality of ICs (e.g., a first operation IC that calculates duty or the like, a second operation IC that performs a determination or the like of varying a control cycle, and the like). At least one of functions of the plurality of ICs may be realized to be performed by the processor 170.

In addition, besides two elements described above, the fuser driver 200 may further include a sensing circuit for sensing zero cross of an AC power source, and the like.

As described above, a control cycle is changed in phases according to a temperature range of a fuser but may be varied in inverse proportion to a sensed temperature.

The fuser driver 200 has been described above as performing merely a control of the number of waveforms hours. However, the above-described method of varying the control cycle may be provided for a method of controlling a power source supplied to a heating element according to a phase control method.

As described above, as a temperature of a fuser is closer to a target temperature, the fuser apparatus according to an example performs a temperature control on a shorter control cycle and thus may perform a more precise temperature control. Also, when a precise control is not needed, the fuser apparatus may perform a temperature control on a long control cycle, and thus resources necessary for a temperature control in the image forming apparatus 100 may be reduced.

Figure 5:
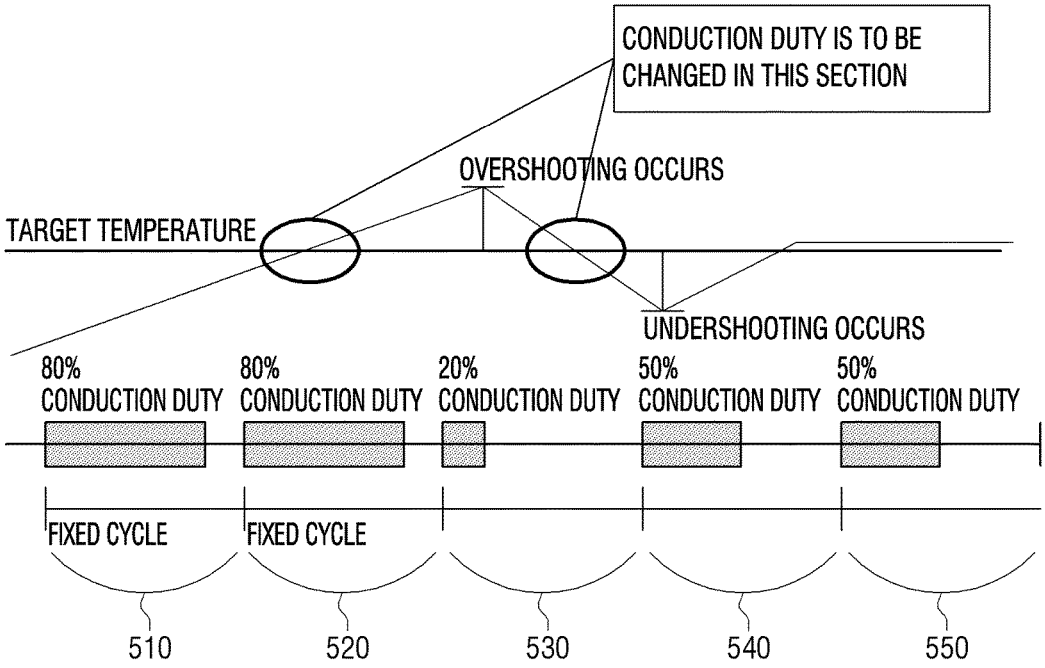
FIGS. 5 and 6 illustrate an operation of a fuser performed if a supply of an alternating current (AC) power source is controlled on a fixed control cycle according to an example.
Figure 6:
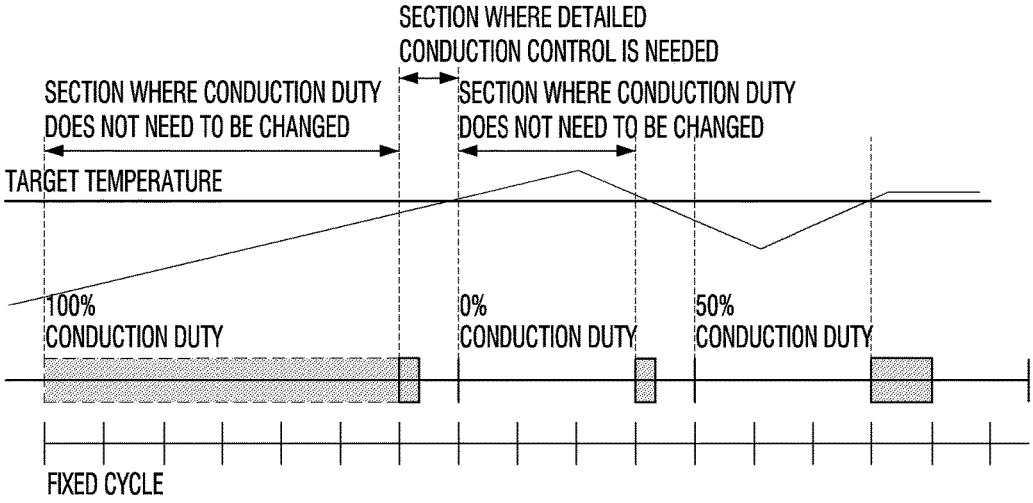

FIGS. 5 and 6 illustrate an operation of a fuser performed if a supply of an AC power source is controlled on a fixed control cycle. In detail, FIG. 5 illustrates an operation of a fuser performed if a supply of an AC power source is controlled on a normal control cycle. Also, FIG. 6 illustrates an operation of the fuser performed if a supply of an AC power source is controlled on a control cycle very shorter than the normal control cycle.

Referring to FIG. 5, the fuser senses a current temperature of the fuser on a fixed control, calculate conduction duty according to a difference between the sensed temperature of the fuser and a target temperature, and determines a cycle to which the corresponding conduction duty is to be applied (or the number of times the corresponding conduction duty being applied). Also, the fuser supplies an AC power source to a heating element by using the conduction duty and the cycle that are determined within the corresponding fixed cycle.

Also, if one cycle 510 ends, the above-described process is periodically repeated.

For example, the fuser may sense a current temperature at a start point of the first cycle 510, calculate conduction duty of 80% based on a difference between the sensed current temperature and a target temperature, and control a power source supply according to the charged duty.

Also, the fuser may sense a current temperature at a start point of a second cycle 520, re-calculate conduction duty (80%) based on a difference between the sensed current temperature and a target temperature, and control a power source supply according to the conduction duty. However, although a temperature of the fuser reaches a target temperature within the second cycle 520, the fuser continuously applies heat by using pre-calculated conduction duty, and thus overshooting occurs.

Also, the fuser may sense a current temperature at a start point of a third cycle 530, calculate low conduction duty (20%) as a temperature of the fuser reaches a current target temperature, and control a power source supply according to the low conduction duty. However, although the temperature of the fuser becomes lower than the target temperature within the third cycle 530, the fuser applies heat merely by the low conduction duty (20%), and thus undershooting occurs.

As described above, if a fusing temperature is controlled by using a fixed cycle, a precise temperature control is difficult. In particular, in an image forming apparatus having fast heating and cooling rates for momentary fusing, overshooting and undershooting described above greatly affect image fusing.

In order to solve this problem, a shorter control cycle than an existing control cycle may be used. This example will now be described with reference to FIG. 6.

Referring to FIG. 6, the fuser senses a current temperature of the fuser on a very short fixed cycle and calculates conduction duty according to a difference between the sensed temperature of the fuser and a target temperature on set fixed cycles. Therefore, overshooting and undershooting occurring close to a target temperature may be considerably reduced in comparison with overshooting and undershooting of FIG. 5.

However, a non-conduction section becomes longer close to a target temperature, and heat loss occurs in a long non-conduction section, and thus a fusing characteristic is not high. Also, since a duty calculation is to be continuously performed in all sections where the fuser is controlled, many resources are necessary for the duty calculation.

Therefore, according to an example, by varying a control cycle according to a difference between a target temperature and a sensed temperature, a precise temperature control may be performed on a short control cycle in a point of time where a precise temperature control is needed, and a temperature control may be performed on a long control cycle in a point of time where the precise temperature control is not needed, thereby reducing CPU load. This operation will be described in detail with reference to FIG. 7.

Figure 7:
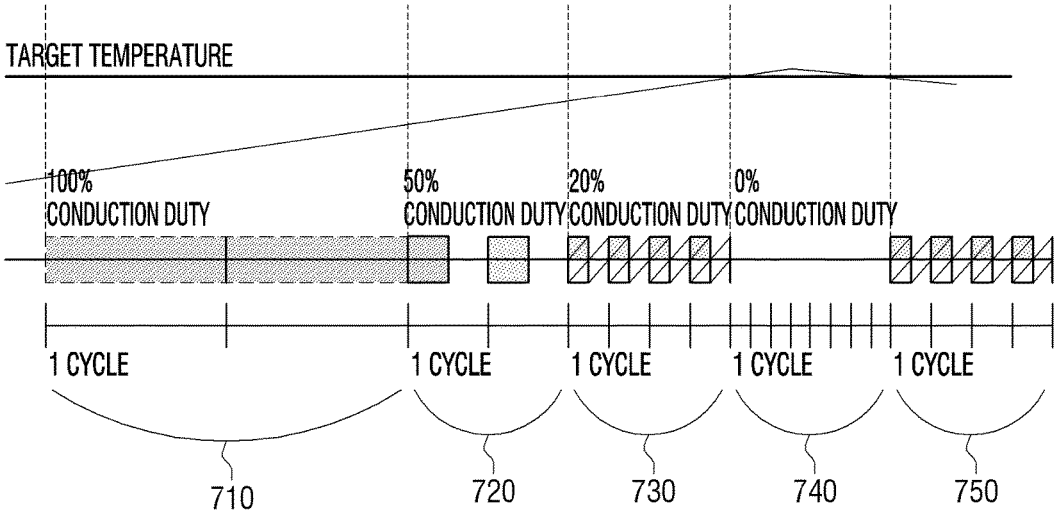
FIGS. 7 through 9 illustrate an operation of a fuser performed if a supply of an AC power source is controlled on a varied control cycle according to an example.
Figure 8:
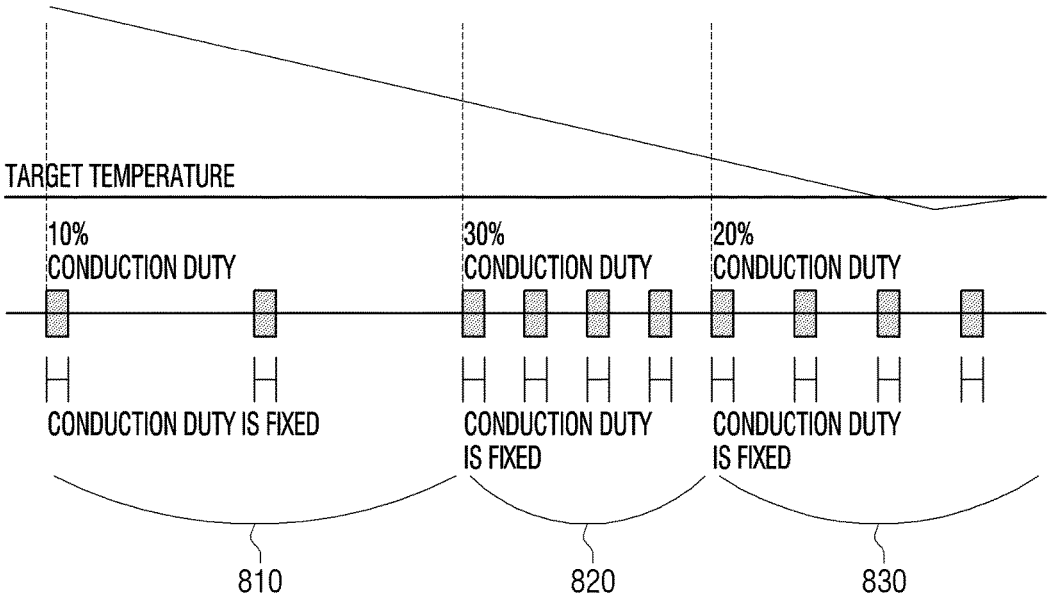
Figure 9:
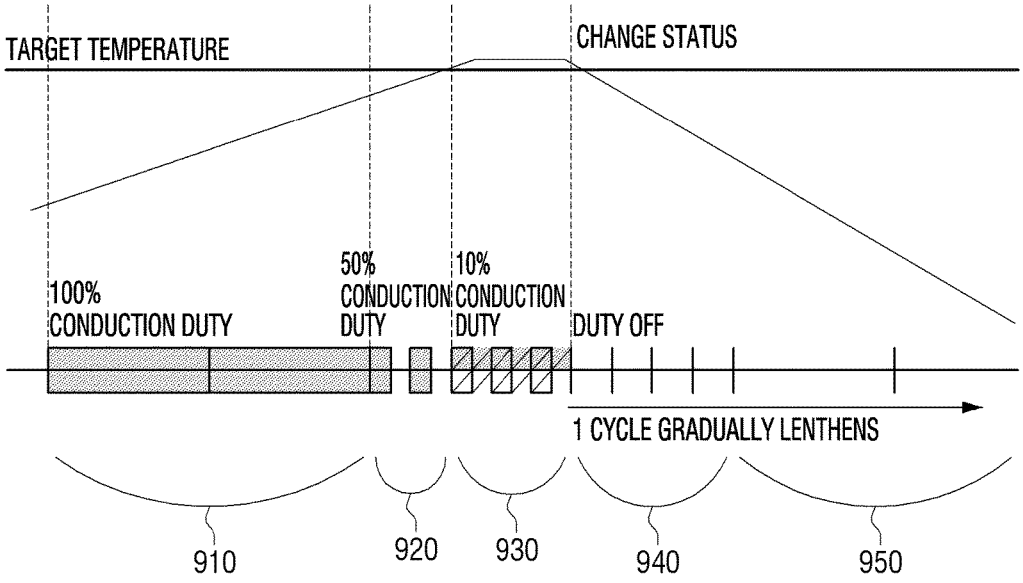

FIGS. 7 through 9 illustrate an operation of a fuser performed if a supply of an AC power source is controlled on a varied control cycle. In detail, FIG. 7 illustrates a control operation of a fuser in a heating process of the fuser. FIG. 8 illustrates a control operation of the fuser in a cooling process of the fuser. FIG. 9 illustrates a control operation of the fuser performed after printing is ended.

Referring to FIG. 7, if a temperature rise of the fuser is needed, on an initial stage, a supply of an AC power source to a heating element may be controlled by calculating first conduction duty and a first conduction cycle by using a first control cycle 710. A duty calculation within one control cycle and a control of a supply of an AC power source according to the calculated duty are the same as the operation of controlling the number of waveforms hours described above, and thus a repeated description thereof is omitted.

Also, if a temperature of a fusing member becomes a first temperature range, a supply of an AC power source to the heating element may be controlled by calculating second conduction duty and a second conduction cycle by using a second control cycle 720 shorter than the first control cycle.

If the temperature of the fusing member becomes a second temperature range higher than the first temperature range, a supply of an AC power source to the heating element may be controlled by calculating third conduction duty and a third conduction cycle by using a third control cycle 730 shorter than the second control cycle 720.

If the temperature of the fusing member becomes a third temperature range higher than the second temperature range, a supply of an AC power source to the heating element may be controlled by calculating fourth conduction duty and a fourth conduction cycle by using a fourth control cycle 740 shorter than the third control cycle 730. Here, the fourth control cycle may have a minimum control time (e.g., 2 ms) in a control of the number of waveforms hours or an integer multiple time of the corresponding minimum control time.

As a fusing cycle becomes very short close to a target temperature as described above, a precise temperature control may be possible at the target temperature, and an amount of heat applied to the fusing member may be easily controlled.

If the temperature of the fusing member is the third temperature range by fusing of a print sheet, a supply of an AC power to the heating element may be controlled by calculating fifth conduction duty and a fifth conduction cycle by using the third control cycle 730 longer than the fourth control cycle 740.

Heating and a fast fusing control in a fusing apparatus may be fast coped with by using a control cycle and conduction duty that vary when controlling fusing.

Also, when the temperature of the fusing member is to be lowered, load necessary for the above-described operation may be reduced by reversely performing the above-described process, i.e., increasing a control cycle. This will be described later with reference to FIG. 9

In a particular section where a control cycle is short, the load necessary for the above-described operation may be reduced by using fixed duty without an operation of duty depending on a sensed temperature. This will be described later with reference to FIG. 8.

Referring to FIG. 8, if a target temperature is lower than a temperature of the fusing member, and thus the temperature of the fusing member is to fall, a supply of an AC power source to the heating element may be controlled by calculating first conduction duty and a first conduction cycle by using a first control cycle 810 on an initial stage.

Also, if the temperature of the fusing member becomes a fourth temperature range, a supply of an AC power source to the heating element may be controlled by calculating second conduction duty and a second conduction cycle by using a second control cycle 820 shorter than the first control cycle 810.

If the temperature of the fusing member becomes a fifth temperature range lower than the fourth temperature range, a supply of the AC power source to the heating element may be controlled by calculating third conduction duty and a third conduction cycle by using a third control cycle 830 shorter than the second control cycle 820.

As shown in FIG. 8, load necessary for all operations may be reduced by using fixed duty within one control cycle. For example, duty that is fixed to 10% may be used on a first cycle, duty that is fixed to 30% may be used on a second cycle, or duty that is fixed to 20% may be used on a third cycle.

Referring to FIG. 9, if a fusing control is to stop after control cycles 910, 920, and 930 become shorter due to a rise of a fuser to a target temperature, and then a fuser operates, i.e., an operation mode of an image forming apparatus is a printing standby mode or a sleep mode, control cycles 940 and 950 may be controlled to lengthen as shown in FIG. 9. Resources necessary for a duty operation may be reduced by re-lengthening a control cycle as described above.

As a control cycle varies according to a temperature change of a fuser as described above, a precise temperature control may be performed, and thus a change of the control cycle may vary at a completed time of a currently performed control cycle. The reason thereof will now be described with reference to FIG. 10.

Figure 10:
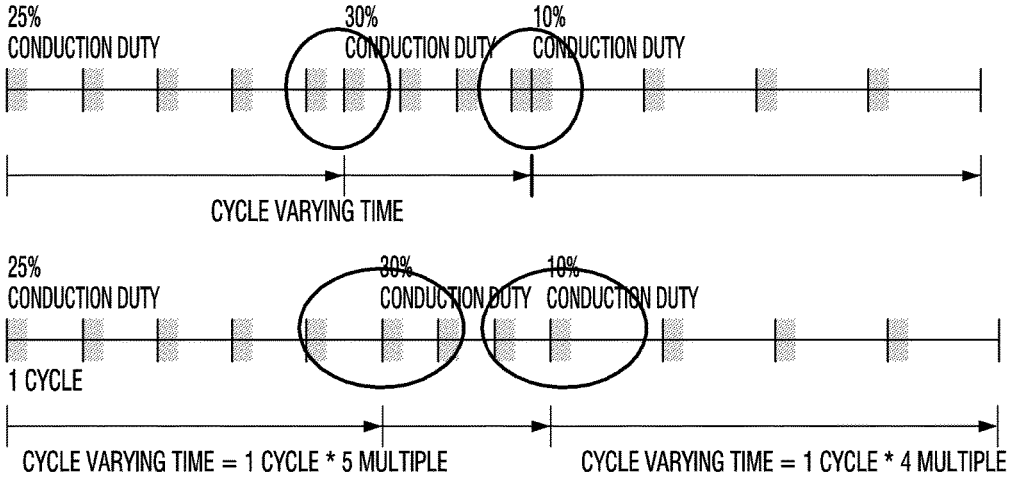
FIG. 10 illustrates a method of determining a change time of a control cycle according to an example.

FIG. 10 illustrates a method of determining a change time of a control cycle. In detail, FIG. 10 illustrates a waveform diagram appearing if a control cycle varies merely according to a temperature condition and a waveform diagram appearing if a control cycle varies at a completed time of the control cycle.

Referring to an upper waveform diagram of FIG. 10, if a temperature of a heating member goes into a preset temperature range, a control cycle is immediately varied. However, if a control cycle is immediately changed according to this temperature change, a power supply may be unintentionally concentrated within a particular time range as marked with circles.

Therefore, in order to prevent this malfunction, as shown with a lower waveform diagram of FIG. 10, the above-described change of the control cycle may be performed in a point of time when a natural number multiple of a current control cycle ends.

Figure 11:
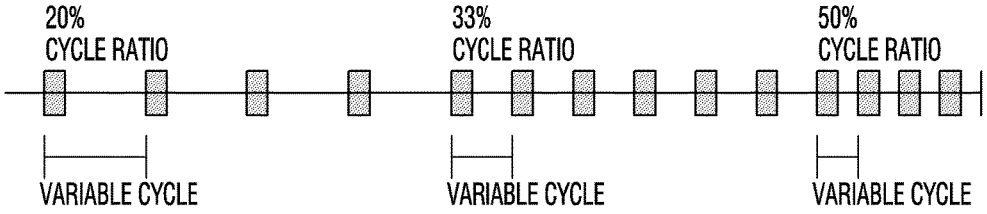
FIG. 11 illustrates controlling of one cycle performed if a time of the cycle is minimized by varying the cycle according to a cycle ratio according to an example.

FIG. 11 illustrates a cycle that is controlled by minimizing a time of one cycle by varying the cycle according to a cycle ratio.

Referring to FIG. 11, a common divisor of a current control cycle value and currently calculated conduction duty may be determined, and a cycle of a minimum unit to be changed may be determined by using the determined common divisor.

For example, if a control cycle having conduction duty of 20% of FIG. 11 is 100 ms, and conduction is made by 200 ms from one cycle 100 ms, a fusing control may be performed as it is wanted.

However, although conduction is made by 1 ms from cycle 5 ms, by 2 ms from cycle 10 ms, or 4 ms from cycle 20 ms, the same result may be acquired.

Therefore, a control cycle may be used within a controllable numerical range among possible examples according to various common divisors. A greatest common divisor of common divisors may be used.

As described above, load of a CPU may be reduced by lengthening a control cycle according to situations and statuses by using a variable control cycle. Also, as a temperature of a fusing member becomes closer to a target temperature, a control cycle may be varied to be short. Therefore, a fast response to a temperature change of the fusing member may be made, and a non-conducted section may be kept short to prevent heat loss occurring during a fusing control by controlling a control cycle to be short.

Figure 12:
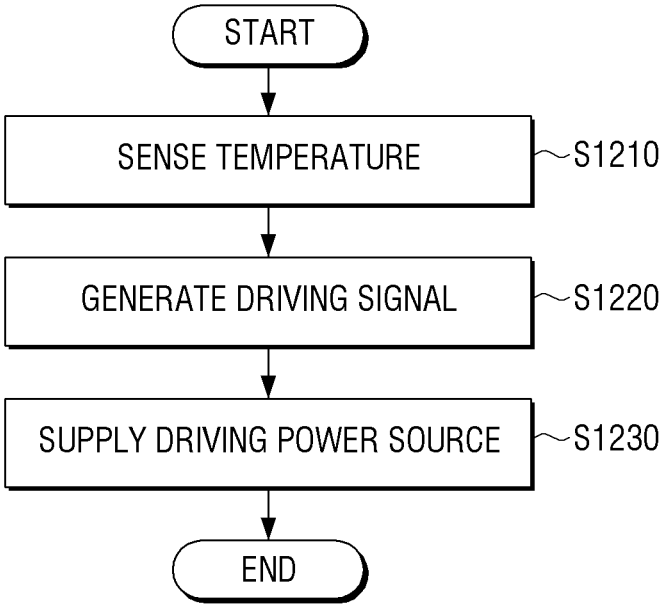
FIG. 12 is a flowchart of a method of controlling a fuser according to an example.

FIG. 12 is a flowchart of a method of controlling a fuser according to an example.

In operation S1210, a temperature of a fuser is sensed. In detail, the temperature of the fuser (in more detail, a fusing member) may be sensed through a temperature sensor disposed in the fuser.

In operation S1220, a driving signal is generated. In detail, the driving signal may be generated by varying a control cycle according to the temperature of the fuser and performing a control of the number of waveforms hours of an AC power source supplied to a heating element within the varied control cycle. For example, if the temperature of the fuser is a first temperature range, a control of the number of waveforms hours of an AC power source, which is supplied to the heating element on a first control cycle, may be performed. If the temperature of the fuser is a second temperature range higher than the first temperature range, the control of the number of waveforms hours of the AC power source, which is supplied to the heating element on a control cycle shorter than the first control cycle, may be performed. Also, conduction duty and a cycle to which the corresponding conduction duty is to be applied may be determined within each control cycle, and the driving signal may be generated based on the determined conduction duty and cycle.

In operation S1230, the AC power source is selectively supplied to the heating element. In detail, the AC power source may be selectively supplied to the heating element by applying the driving signal to a switching element. The AC power source may be first rectified, and the rectified AC power source may be supplied to the heating element.

Therefore, the method of driving and controlling the fuser according to an example may perform a temperature control on a shorter control cycle as a temperature of the fuser becomes closer to a target temperature, thereby performing a more precise temperature control. The method of driving and controlling the fuser shown in FIG. 12 may be executed on an image forming apparatus having the structure of FIG. 1 or 2, on a fusing apparatus having the structure of FIG. 4, or on image forming apparatuses or fusing apparatuses having other types of structures.

Also, the above-described method may be realized as at least one execution program for executing the above-described method, and the execution program may be stored on a computer readable recording medium.

Therefore, blocks according to an example of the present disclosure may be executed as computer recordable codes on a computer readable recording medium. The computer readable recording medium may be a device capable of storing data that may be read by a computer system.

The foregoing examples are merely examples and are not to be construed as limiting claimed subject matter. The present teaching can be readily applied to other types of apparatuses. Also, the description according the examples of the present disclosure is intended to be illustrative, and not to limit the scope of the claims, and many alternatives, modifications, and variations.

What is claimed is:

1. An image forming apparatus comprising:

a fuser to fuse a print sheet having a surface on which toner is developed, the fuser including a heating element; and a controller to control a number of waveforms of an alternating current (AC) power to be supplied to the heating element within a control cycle to control the fuser to fuse the print sheet at a target temperature and to vary the control cycle according to a temperature of the fuser.

2. The image forming apparatus of claim 1, further comprising:

a temperature sensor to sense the temperature of the fuser, wherein the controller is to vary the control cycle based on a difference between the temperature sensed by the temperature sensor and the target temperature.

3. The image forming apparatus of claim 2, wherein the controller is to:

determine a conduction duty and a cycle to which the conduction duty is to be applied, based on the temperature sensed by the temperature sensor, and supply the AC power to the heating element based on the determined conduction duty and the determined cycle.

4. The image forming apparatus of claim 1, wherein the controller is to determine the control cycle to be varied by at least one multiple of the control cycle that is currently set.

5. The image forming apparatus of claim 1, wherein the controller is to control the heating element with the AC power based on a fixed conduction duty within the control cycle.

6. The image forming apparatus of claim 5, wherein the fixed conduction duty is 50%.

7. The image forming apparatus of claim 1, wherein the controller is to vary the control cycle in inverse proportion to the temperature of the fuser.

8. The image forming apparatus of claim 1, wherein the controller is to control the number of waveforms of the AC power to be supplied to the heating element within the control cycle that is varied to be a first control cycle, in response to the temperature of the fuser being in a first temperature range, and control the number of waveforms of the AC power to be supplied to the heating element within the control cycle that is varied to be a second control cycle shorter than the first control cycle, in response to the temperature of the fuser being in a second temperature range higher than the first temperature range.

9. The image forming apparatus of claim 1, wherein:

the fuser includes a fusing member including a cylindrical belt to transmit heat to the print sheet having the surface on which the toner is developed; and the heating element is to be provided in the cylindrical belt so as to heat the fusing member.

10. The image forming apparatus of claim 9, wherein the heating element is to heat the cylindrical belt with contactless radiant heat.

11. The image forming apparatus of claim 1, wherein the controller is a fuser driver to supply the AC power to the heating element of the fuser, or at least one processor to generate a driving signal to control the fuser driver to selectively supply the AC power to the heating element of the fuser.

12. A method of controlling a fuser of an image forming apparatus, the method comprising:

sensing, by a sensor of the image forming apparatus, a temperature of the fuser to fuse a print sheet having a surface on which toner is developed, the fuser including a heating element;

generating, by a controller of the image forming apparatus, a driving signal to control a number of waveforms of an alternating current (AC) power to be supplied to the heating element within a control cycle to control the fuser to fuse the print sheet at a target temperature and to vary the control cycle according to the temperature of the fuser.

13. The method of claim 12, wherein the control cycle is varied based on a difference between the temperature of the fuser and the target temperature.

14. The method of claim 12, wherein the generating the driving signal further comprises:

determining a conduction duty and a cycle to which the conduction duty is to be applied, based on the temperature sensed by the sensor, and generating the driving signal to supply the AC power to the heating element based on the determined conduction duty and the determined cycle.

15. The method of claim 12, wherein the control cycle is varied by at least one multiple of the control cycle that is currently set.

16. The method of claim 12, wherein the controller is control the heating element with the AC power based on a fixed conduction duty within the control cycle.

17. The method of claim 16, wherein the fixed conduction duty is 50%.

18. The method of claim 12, wherein the control cycle is to be varied in inverse proportion to the temperature of the fuser.

19. The method of claim 12, wherein the generating the driving signal further comprises:

generating the driving signal to control the number of waveforms of the AC power to be supplied to the heating element within the control cycle that is varied to be a first control cycle, in response to the temperature of the fuser being in a first temperature range, and generating the driving signal to control the number of waveforms of an AC power to be supplied to the heating element within the control cycle that is varied to be a second control cycle shorter than the first control cycle, in response to the temperature of the fuser being in a second temperature range higher than the first temperature range.

20. A fuser control device of an image forming apparatus, the fuser control device comprising:

a controller to obtain a temperature of a fuser to fuse a print sheet having a surface on which toner is developed, the fuser including a heating element; and control a number of waveforms of an alternating current (AC) power to be supplied to the heating element of the fuser within a control cycle to control the fuser to fuse a print sheet at a target temperature and to vary the control cycle, according to the temperature of the fuser.

* * * * *